US005555835A

United States Patent [19]

Campolucci

[11] Patent Number: 5,555,835

[45] Date of Patent: Sep. 17, 1996

[54] AUTOMATIC PROCEDURE FOR SEWING PRE-IRONED PATCH POCKETS

[75] Inventor: Carlo Campolucci, Corinaldo, Italy

[73] Assignee: J.A.M. - S.R.L., Italy

[21] Appl. No.: 268,282

[22] Filed: Jun. 30, 1994

[51] Int. Cl.[6] ..... D05B 21/00

[52] U.S. Cl. ..... 112/475.07; 112/475.09; 112/470.05; 112/470.07

[58] Field of Search ..... 112/262.3, 121.12, 112/121.11, 121.15, 121.29, 311, 104, 113, 114, 475.09, 475.08, 474.07, 470.05, 470.06, 470.07, 470.36

[56] References Cited

U.S. PATENT DOCUMENTS 4,928,608 5/1990 Schips ..... 112/104
4,996,931 3/1991 Mall ..... 112/121.12
5,003,897 4/1991 Yokoe et al. ..... 112/121.12
5,123,367 6/1992 Black et al. ..... 112/121.12 X
5,255,621 10/1993 Schramayr et al. ..... 112/121.12

*Primary Examiner*—Peter Nerbun
*Attorney, Agent, or Firm*—Leonard Bloom

[57] ABSTRACT

The present invention is a method and a machine for automatic sewing of pre-ironed patch pockets to clothing items. The clothing item and the pocket are manually positioned on a work surface at one end of the machine while a previous pocket is sewn to the previous clothing item at a sewing station. After the previous pocket is sewn, a feeder automatically feeds the clothing item to the sewing station while an unloading device simultaneously unloads the previous clothing item from the sewing station to another end of the machine (opposite to said one end). Operations of the feeder, of the unloading device and the double clip at the sewing station are synchronized.

13 Claims, 2 Drawing Sheets

AUTOMATIC PROCEDURE FOR SEWING PRE-IRONED PATCH POCKETS

BACKGROUND OF THE INVENTION

This invention concerns an automatic procedure and machine necessary to realize the same, for sewing pre-ironed patch pockets.

Pre-ironed patch pockets are currently applied by means of special sewing machines that automatically sew the pocket on to the clothing item in question, such as the relevant section of pants, a shirt or a jacket.

These machines are characterized by a double clip under the sewing head, mounted on a trolley that moves along two orthogonal axes.

Said double clip consists of a fabric-holding plate and a pocket-holding plate operating within the first; more specifically, the larger fabric-holding plate features a wide center opening conforming perfectly to the shape of the pocket to be applied on the fabric.

The shape of the pocket-holding plate is similar to that of said opening, but smaller so as to house within the same allowing a space along the perimeter along which the needle moves during sewing.

Said double clip is designed firstly to hold the pocket and clothing fabric separately above the sewing surface and secondly to pull the pocket and clothing item together along a closed curved line, coinciding with the sewing line.

In this type of sewing machine, the clothing item and the pocket are loaded manually by the operator.

In particular the operating cycle includes the following phases:

A) Manual loading of the clothing item under the sewing head and under the raised double clip;

B) Lowering by the operator of the fabric-holder plate;

C) Manual positioning of the pocket in the centering opening of the fabric-holding plate;

D) Lowering by the operator of the pocket-holder plate;

E) Starting by the operator of the sewing phase followed by the automatic unloading of the sewn clothing item that is lifted and stacked in front of the sewing machine, just in front of the sewing station.

Some sewing machine models feature an automatic device for loading the clothing item; this device consists essentially of a special clip that lifts the clothing item from a storage station and transfers the same under the fabric-holder plate which then lowers automatically on the fabric when this is released by the carrying clip.

Even in these cases, the pockets are loaded manually by the operator who first places the pocket into the centering opening on the fabric-holder plate and then lowers the latter, and starts sewing.

BRIEF SUMMARY OF THE INVENTION

The purpose of this invention is to design an industrial operating procedure and machine for performing the same whereby the manual application of the pocket on the clothing item occurs during the sewing phase of another previously applied pocket so as to reduce the duration of each operating cycle.

This objective has been achieved by applying the pocket onto the clothing item before the latter is under the above double clip.

In other words, the procedure according to the invention is characterized in that the clothing item arrives at the sewing station together with the pocket previously positioned above the same at the correct application point at one end of the machine. In order to further reduce the duration of the operating cycle, the procedure according to the invention includes the automatic lateral unloading of the sewn clothing item, which is unloaded by the machine, from the sewing station towards another end of the machine located at opposite side of the sewing station from said one end of the machine from which the clothing item is fed to the sewing station, rather than in front of the machine as in the case of current machines.

This feature makes it possible to clear the sewing station very quickly after sewing and eliminates the dead times required to replace the sewn clothing item with another clothing item.

The machine that performs the operating procedure according to the invention involves the innovative use, with respect to above current machines, of two new devices: a feeder for automatically feeding the clothing item to the sewing station and an unloading means for the lateral unloading of the clothing item sewn at the sewing station.

The first device, in other words, the device for feeding the sewing station includes a mobile fabric-holder clip (or an auxiliary fabric holder) that holds the clothing item above the sewing working surface and moves it along said working surface until the item is under the sewing station.

Said clip (the auxiliary fabric holder) consists of a plate having a center opening conforming perfectly to the shape of the pocket, which is placed into said centering opening by the operator when the fabric is pressed under said clip.

The second device, in other words, the device for unloading the sewn clothing item from the sewing station towards said another and of the machine, consists of a trolley featuring clamping and pulling mechanisms, sliding along a pair of horizontal support and guiding bars, placed at said another end of the machine opposite to the pocket application station (at said one end of the machine).

Operations of the feeder, the double clip and the unloading means are synchronized by a respective controlling means which provides the following sequence of operative steps: after manual positioning of the clothing item at said one end of the machine, lowering the auxiliary fabric holder over the clothing item and applying the pocket within the opening in the auxiliary fabric holder, the clothing item is automatically fed (by means of the feeder) from said one end of the machine to the sewing station. It will be appreciated by those skilled in the art, that the fabric-holding plate and the pocket-holding plate of the double clip during the above described steps are lifted over the working surface of the machine.

Then, the pocket-holding plate of the double clip is automatically lowered into the opening of the auxiliary fabric holder, and the auxiliary fabric holder is automatically raised and returned to said one end of the machine. Further, the fabric-holding plate of the double clip is automatically lowered onto the clothing item within the centering opening of the fabric-holding plate, and the pocket is sewn to the clothing item. Finally, the clothing item with the sewn pocket is pulled by the unloading means from the sewing station towards said another end of the machine, where it further is unloaded by a standard automatic unloading and stacking device towards the front of the machine.

When the auxiliary fabric holder is returned to said one end, another clothing item is manually positioned at said one end of the machine, the auxiliary fabric holder is lowered down onto the clothing item and another pocket is applied to the another clothing item within the opening in the auxiliary fabric holder. As soon as the pocket is sewn at the sewing station, the double clip is raised and the clothing item with the sewn pockets is pulled away towards said another end of the machine. Simultaneously, another clothing item is fed to the sewing station.

BRIEF DESCRIPTION OF THE DRAWINGS

For major clarity the description of the invention continues with reference to the enclosed drawings which are intended for purposes of illustration and not in a limiting sense where.

DESCRIPTION

Figure 1:
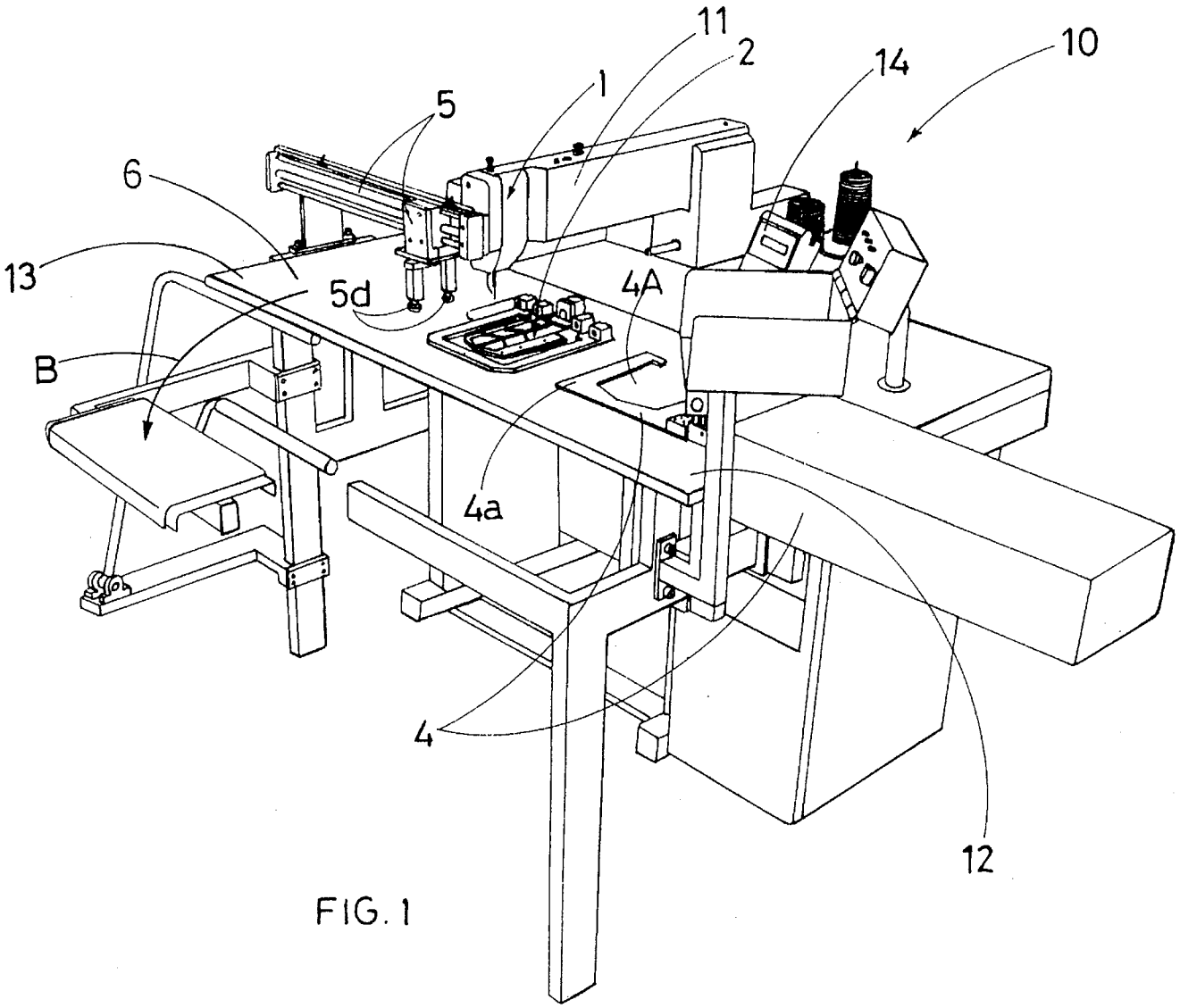
FIG. 1 is a perspective view of the machine for performing the operating procedure according to the invention.
Figure 2:
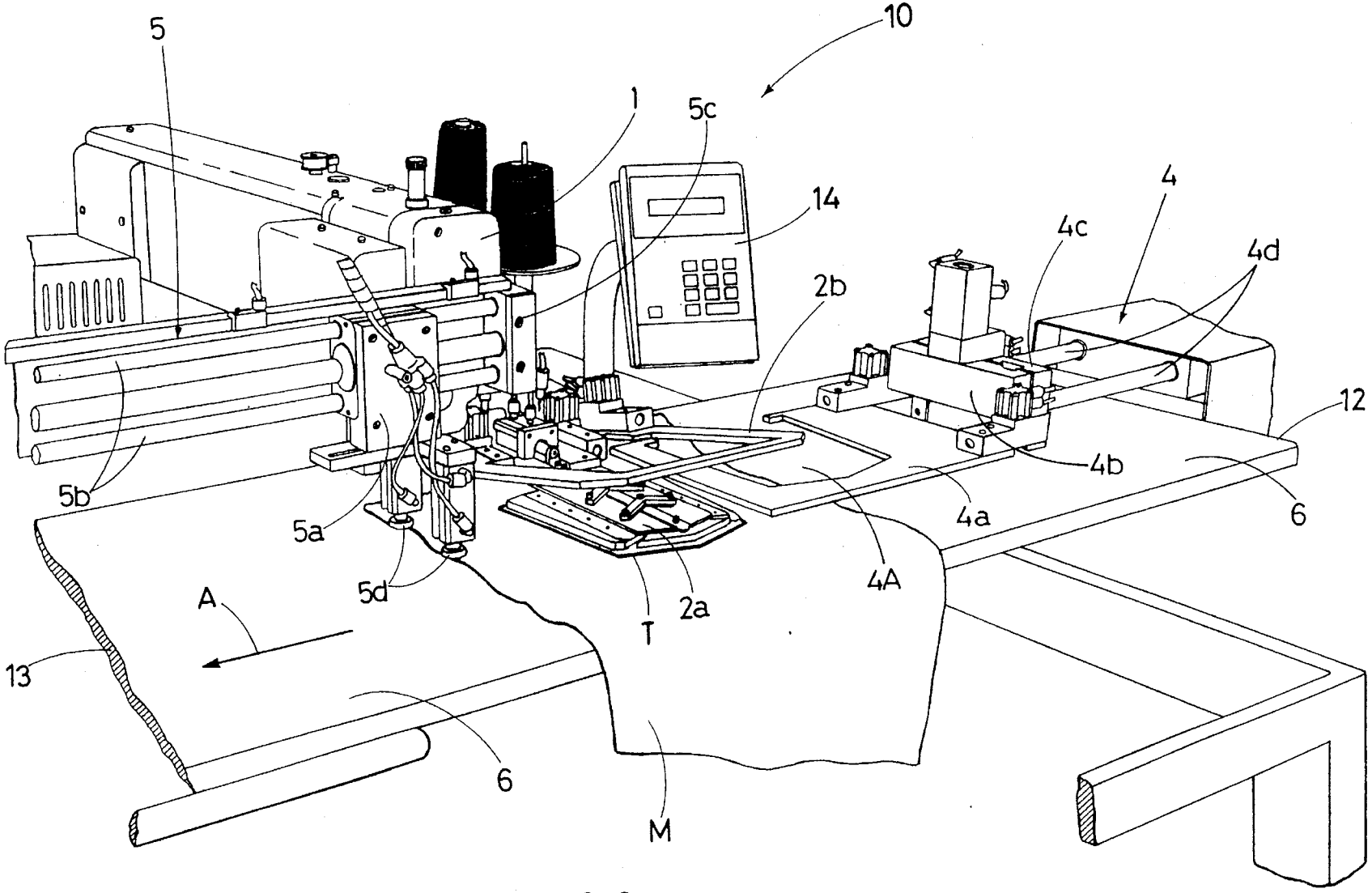
FIG. 2 is a close up of the feeding and unloading devices of the sewing station.

With reference to FIGS. 1 and 2, the machine (10) in question consists conventionally of a sewing head (1) and a double motor driven clip (2) comprising of a pocket-holder plate (2*a*) and a fabric-holder plate (2*b*).

The machine 10 according to the invention is characterized by a feeder (4) for the automatic feeding of the clothing items (M) to the sewing station (11) and by an unloading device (5) for the automatic lateral unloading of the clothing item (M) sewn at the sewing station.

The feeder (4) includes on auxillary fabric holder (4*a*) supported by a staggered supporting slide (sliding member) (4*b*) sliding vertically with respect to a bracket (4*c*) mounted on the rods (4*d*) of a pair of pneumatic jacks having a horizontal axis.

Said auxillary fabric holder (4*a*) is characterized by a center opening (4A) having a shape and a size conforming to that of the pocket to be applied.

The unloading device (5) consists of a trolley (5*a*), that is moved by a pneumatic actuator along a horizontal pair of support and guiding bars (5*b*), supported by a bearing frame (5*c*) above the sewing (a working) surface (6), extending longitudinally on both the sides of the sewing station (from one end (12) of the machine (10) to another end (13)).

Two adjacent pneumatic jacks having a vertical axis are mounted on trolley (5*a*) while two plates (5*d*) that hold and pull the clothing item (M) from under the double clip (2) after sewing, in the direction A to the end (13) of the machine (10), as best shown in FIG. 2, are applied under the rods of the pneumatic jacks.

The procedure according to the invention consists of the following steps:

a) manual loading of the clothing item on the work surface (6) under the raised auxiliary fabricholder (4*a*);

b) lowering by the operator the auxiliary fabric holder (4*a*) over the clothing item (M);

c) manual application of the pocket (T) in the opening (4A) of the holder (4*a*); start up of the automatic operating cycle which includes the following rapid operating sequences (as best shown in FIG. 2):

automatically feeding, by means of the feeder (4), the clothing item (M) with the applied pocket (T) from the end (12) to the sewing station (11), automatically lowering the pocket-holding plate (2*a*) of the double clip 2 into the opening (4A) of the auxiliary fabric holder (4*a*), automatically raising the auxiliary fabric holder (4*a*) and returning it to the end (12) of the sewing machine (10), automatically lowering the fabric-holding plate (2*b*) of the double clip (2) onto the clothing item (M), sewing the pocket (T) to the clothing item (M), and automatically unloading, by said unloading, means (5), the clothing item (M) with the sewn pocket (T) from the sewing station (11) towards the end (13) of the machine (10).

And finally, as best shown in FIG. 1 unloading in the direction B the clothing item towards the front of the working surface (6) by means of a standard automatic unloading and stacking device which is known to those skilled in the art.

It should be noted that the manual loading of the clothing item (M) on the working surface (6) and the application of pocket (T) occur during the sewing phase of the previously applied pocket, (T). Also it will be appreciated by those skilled in the art, that the automatic feeding phase of the clothing item (M) to the sewing station (11) occurs simultaneously with the unloading of the previous clothing item from the sewing station. (11) to the another end (13) of the machine (10)

In particular, as soon as the pocket has been sewn, the double clip (2) rises and devices (4 and 5) are operated simultaneously so that they perform synchronous strokes in same direction as the trolley (5*a*) and the fabric-holder plate (4*a*).

This means that while trolley (5*a*) pulls the clothing item (M) with the sewn pocket (T) away from the sewing station (11) to the another end (13) of the machine, the holder (4*a*) feeds the sewing station with a new clothing item (M) with the pocket pre-positioned at the exact sewing point.

Obviously the entire operating procedure is controlled by a controlling means (14) including an electronic programming and control board that receives, processes and transmits all the signals required for correct sequence synchronization of all the operating phases of the entire operating cycle.

I claim:

1. In a sewing machine comprising a sewing station with a sewing head and a working surface extending from one end of the sewing machine to another end thereof, wherein a double clip is installed at the sewing station, the double clip including a fabric-holding plate and a pocket-holding plate, wherein the fabric-holding plate has a centering opening substantially conforming to a shape and a size of a pocket to be sewn to a clothing item, wherein the pocket-holding plate, being positioned within said centering opening, allows a certain distance between perimeters of the centering opening and the pocket-holding plate identifying a sewing line, and wherein, during the sewing of the pocket to the clothing item, a needle of the sewing head moves along said sewing line, a method for sewing the pocket to the clothing item, comprising the steps of:

a. providing a feeder on said one end of the sewing machine for feeding a clothing item to the sewing station, wherein the feeder includes an auxiliary fabric holder having an opening substantially conforming to the shape and the size of the pocket;

b. providing an unloading means for unloading the clothing item from the sewing station toward said another end of the sewing machine;

c. providing a controlling means for synchronization of operations of the feeder, unloading means and the double clip;

d. manually loading the clothing item on the working surface at said one end of the sewing machine while the auxiliary fabric holder is raised;

e. lowering the auxiliary fabric holder over the clothing item loaded onto the working surface;

f. manually applying the pocket within the opening of the auxiliary fabric holder;

g. automatically feeding the clothing item with the applied pocket by means of said feeder from said one end of the sewing machine to the sewing station;

h. automatically lowering the pocket-holding plate of the double clip into the opening of the auxiliary fabric holder;

i. automatically raising the auxiliary fabric holder and returning it to said one end of the sewing machine;

j. automatically lowering the fabric-holding plate of the double clip onto the clothing item;

k. sewing the pocket to the clothing item; and

1. automatically unloading by said unloading means the clothing item with the sewn pocket from the sewing station to said another end of the sewing machine.

2. The method of claim 1, wherein another pocket is to be sewn to another clothing item, further including the steps d, e, f, in sequence, for said another clothing item and said another pocket after said step i for said clothing item and said pocket has been performed; and simultaneously performing the step 1 for said clothing item with the said sewn pocket and the step g for said another clothing item and said another pocket.

3. The method of claim 1, further including the step of unloading the clothing item with the sewn pocket from said another end of the sewing machine.

4. The method of claim 3, wherein the clothing item with the sewn pocket is unloaded towards a front of the sewing machine.

5. The method of claim 1, wherein the pocket is a pre-ironed patch pocket.

6. A machine for sewing a pre-ironed pocket to a clothing item, comprising:

a working surface extending from one end of the machine to another end thereof;

a sewing station positioned between said one end and said another end, the sewing station comprising a sewing head;

a double clip installed at the sewing station under the sewing head for holding the pocket and the clothing item on the working surface and for pulling the pocket and the clothing item together such that a needle of the sewing head moves along a sewing line;

a feeder at said one end of the machine for feeding the clothing item from said one end of the machine to the sewing station;

an unloading means for unloading the clothing item with the pocket sewn thereon from the sewing station toward said another end of the machine; and a controlling means for synchronization of operations of said feeder, said double clip, and said unloading means.

7. The machine of claim 6, wherein the double clip includes a fabric-holding plate and a pocket-holding plate, wherein the fabric-holding plate has a centering opening substantially conforming to a shape of the pocket to be sewn to the clothing item, wherein the pocket-holding plate, being positioned within said centering opening, allows a certain distance between perimeters of the centering opening and the pocket-holding plate, and wherein, during the sewing of the pocket to the clothing item, a needle of the sewing head moves along said sewing line within said certain distance.

8. The machine of claim 6, wherein the feeder comprises:

an auxiliary fabric holder having an opening substantially conforming to a shape of the pocket, and means for positioning said auxiliary fabric holder.

9. The machine of claim 8, wherein the means for positioning of said auxiliary fabric holder includes a bracket mounted on a pair of horizontal rods, such that the bracket moves reciprocally along said rods, and a sliding member supporting the auxiliary fabric holder, the sliding member being installed on the bracket and moving vertically relative to the bracket.

10. The machine of claim 9, wherein the pair of horizontal rods includes a pair of pneumatic jacks.

11. The machine of claim 6, wherein the unloading means includes horizontal guiding bars extending from said another end of the machine to the sewing station, a trolley reciprocally moving along said guiding bars, and a pair of plates moving vertically relative to the trolley, such that, being lowered down to the working surface and engaging the clothing item, said pair of plates pulls the clothing item from the sewing station to said another end of the machine.

12. The machine of claim 11, wherein the trolley is driven by a pneumatic actuator along the guiding bars, wherein the guiding bars are supported by a bearing frame above the working surface, and wherein said pair of plates is driven by a pair of vertical pneumatic jacks mounted on the trolley.

13. The machine of claim 6, wherein the double clip is driven by a motor.

* * * * *